US005174028A

United States Patent [19]

Seltzer, Jr.

[11] Patent Number: 5,174,028

[45] Date of Patent: Dec. 29, 1992

[54] UTILITY KNIFE

[76] Inventor: Roger E. Seltzer, Jr., 685 Railroad St., Millersburg, Pa. 17061

[21] Appl. No.: 784,876

[22] Filed: Oct. 30, 1991

[51] Int. Cl.[5] ..... B26B 5/00

[52] U.S. Cl. ..... 30/337; 30/329; 30/340

[58] Field of Search ..... 30/162, 156, 157, 158, 30/337, 125, 329, 339, 340; D8/98, 107, DIG. 4, DIG. 7; 81/177.1, 177.7, 177.8, 177.9, 489; 411/378

[56] References Cited

U.S. PATENT DOCUMENTS

| | | | |
|---|---|---|---|
| D. 235,414 | 6/1975 | Miller | D8/98 |
| D. 311,854 | 11/1990 | Wilson et al. | D8/98 |
| 756,615 | 4/1904 | Fornander | 30/47 |
| 2,416,913 | 3/1947 | Debbio et al. | 30/162 |
| 3,604,113 | 9/1971 | Cuscovitch | 30/337 |
| 4,109,380 | 8/1978 | Anderson | 30/162 |
| 4,884,342 | 12/1989 | McNamara et al. | 30/339 |
| 4,936,014 | 6/1990 | Shaanan et al. | 30/329 |

*Primary Examiner*—Douglas D. Watts
*Assistant Examiner*—Hwei-Siu Payer
*Attorney, Agent, or Firm*—Richard C. Litman

[57] ABSTRACT

This invention relates to a utility knife having a handle with two or more angular bends. The utility knife has replaceable blade, which may be retractable, clamped in the nose of the knife handle. The knife handle is hollow and separable to accommodate the storage of spare blades in the handle. Most utility knives either have handles which are substantially straight or which have a single angular bend. These knives are more limited in their application or produce difficulty in cutting materials in an obstructed area. A knife having a handle with two or more bends enables the user to cut materials in close quarters or in obstructed areas with greater ease. Different handles provide greater reach or leverage under different circumstances. An alternative knife includes a handle with two or more angular bends, one of which is adjustable. This allows the user to select a configuration that offers optimum reach and leverage. A knife of this type is particularly useful in cutting around radiators, toilets, cabinets and appliances. Another alternative knife includes a handle with a nodule on the butt end opposite the blade end. This nodule aids the grip by the user.

5 Claims, 3 Drawing Sheets 14d
22d
38d
36
44d
64
16
18
28d
30d
26d
24d
66
20
42d
62
78
72
68
74
70
82
80
76
60

UTILITY KNIFE

BACKGROUND OF THE INVENTION

1. Field of the Invention

The present invention relates to a utility knife, specifically to a utility knife having a handle with a plurality of angular bends to enable the user to more easily cut materials in tight work areas.

2. Description of Prior Art

Utility knives are commonly used in the construction trades, particularly in the installation of drywall, carpeting and vinyl siding to name a few.

Tradesmen often have to work in tight areas such as around radiators, toilets, appliances and cabinets where the material which needs to be cut is grossly obstructed. The work area may not provide enough space to apply the required leverage or to even reach the material which needs to be cut. It is in a crowded work space where a knife with a handle having multiple angular bends could reduce the effort required to do the job.

U.S. Pat. Nos. D311, 854 to WILSON et al. (issued Nov. 6, 1990), 3,927,473 to BRAGINETZ (issued Dec. 23, 1975), and 4,068,375 to RATHBUN et al. (issued Jan. 17, 1978) are all directed to utility knives, each with handles having a single angular bend, having either a retractable or a clamped replaceable blade and a separable hollow handle for the storage of replacement blades.

Heretofore, utility knives either had substantially straight handles or handles with a single angular bend. A utility knife of this type may not enable the user to cut materials in a cramped or obstructed place or to apply the leverage needed.

Accordingly, an object and advantage of the present invention is to provide a utility knife with a handle having a plurality of angular bends which would enable the user to cut materials around heavily obstructed areas with greater ease.

It is another object of the present invention to provide alternative embodiments of a utility knife, each embodiment having a different handle with a different combination of angular bends, one handle suited to provide greater leverage and reach than another in a particular situation.

It is another object of the present invention to provide an alternative embodiment of a utility knife with at least two angular bends with at least one angular bend being adjustable.

It is further an object of the present invention to provide an alternative embodiment of a utility knife with a nodule on the butt end of the handle, the end opposite the blade end. This nodule enhances the grip of the user, thus improving the control of the utility knife.

These and other objects of the present invention will become readily apparent upon further review of the following specification and drawings.

SUMMARY OF THE INVENTION

The above objects are accomplished in accordance with the present invention, by a utility knife having a handle with a plurality of angular bends which is capable of providing enhanced reach and leverage in a crowded space. The utility knife is comprised of a separable hollow elongated handle having a cutting blade, which may be retractable, which is clamped in one end of the handle. The handle may be hollow and completely separable into two half sections; one half section may provide a storage compartment adjacent its interior for storing space blades. Alternative handles can be of varying configurations, each configuration having a unique set of angular bends, each offering optimum reach or leverage in a given set of working conditions. An alternative utility knife has at least two angular bends, at least one of which is be adjustable. As an option, the utility knife could have a nodule on the butt end of the knife, the end opposite the blade end. This enhances the grip of the user thereby providing greater control.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1:
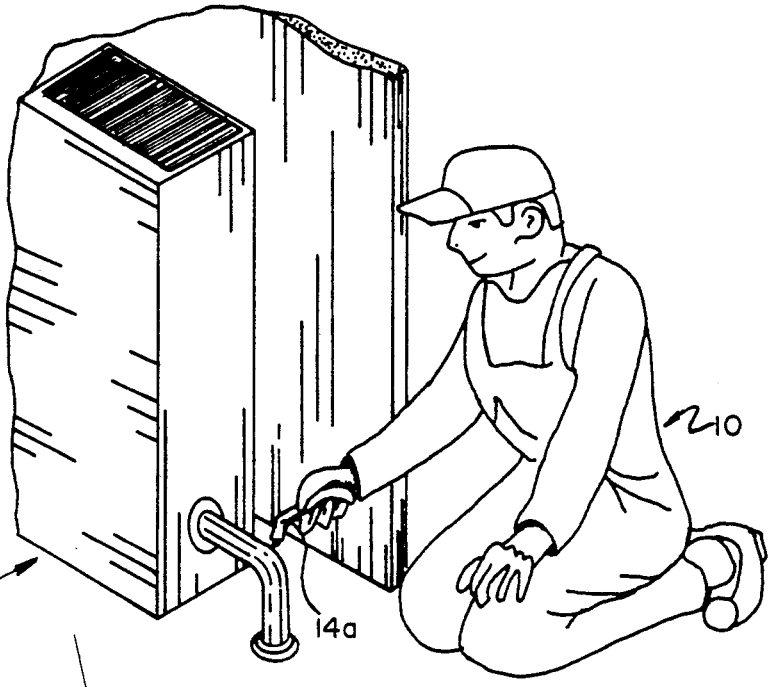
FIG. 1 is an environmental view of the first alternative embodiment of the present invention in use.

Referring to FIG. 1, the first alternative embodiment of the present invention is a utility knife 14*a* which makes it permissible for the user 10 to cut material in a close and obstructed work area, such as around a radiator 12 as shown.

Figure 2:
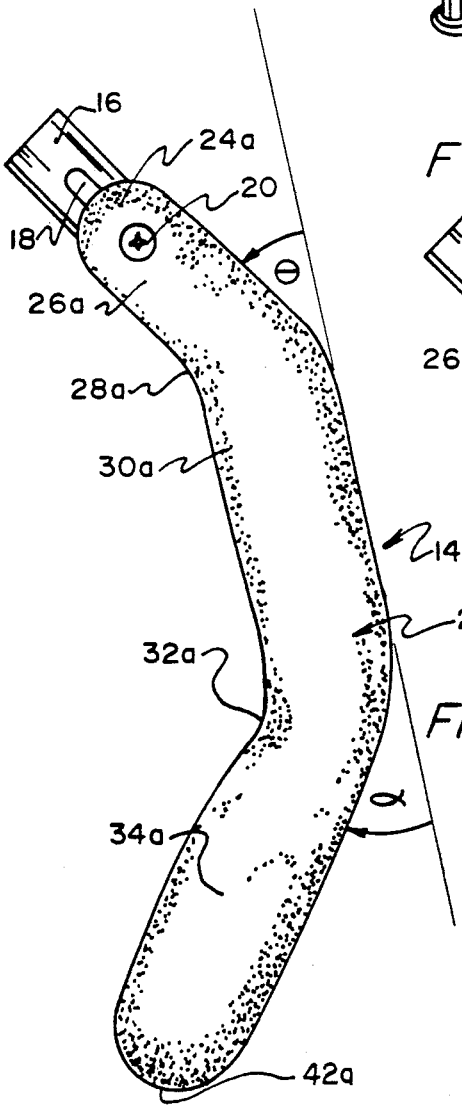
FIG. 2 is a side elevational view of the first alternative embodiment of the present invention.
Figure 3:
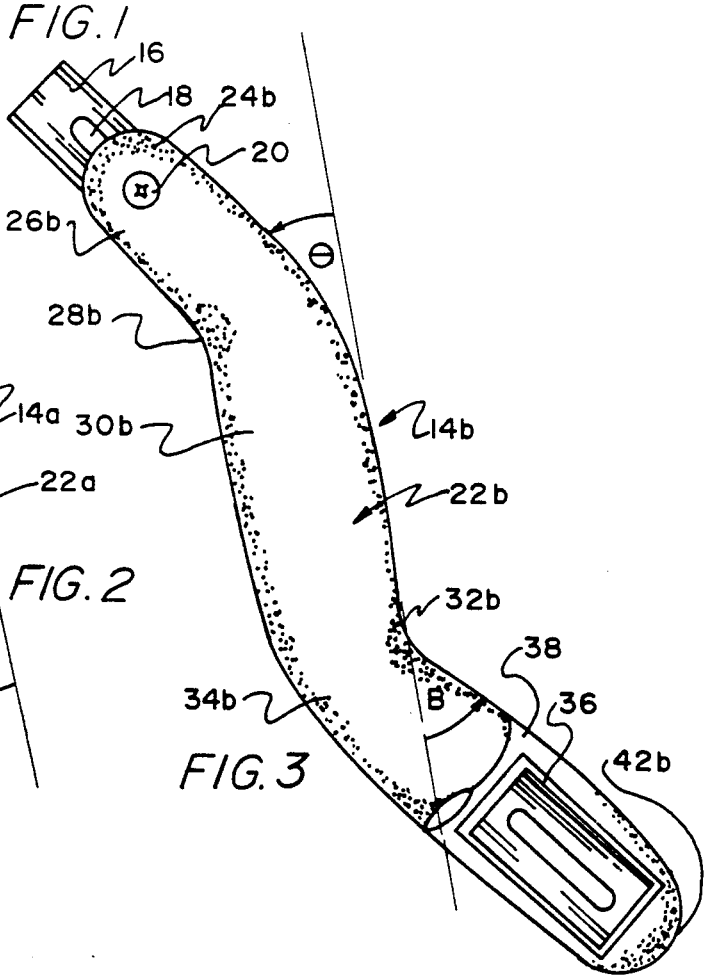
FIG. 3 is a side elevational partially cutaway view of the second alternative embodiment of the present invention showing the storage of the spare blades.
Figure 5:
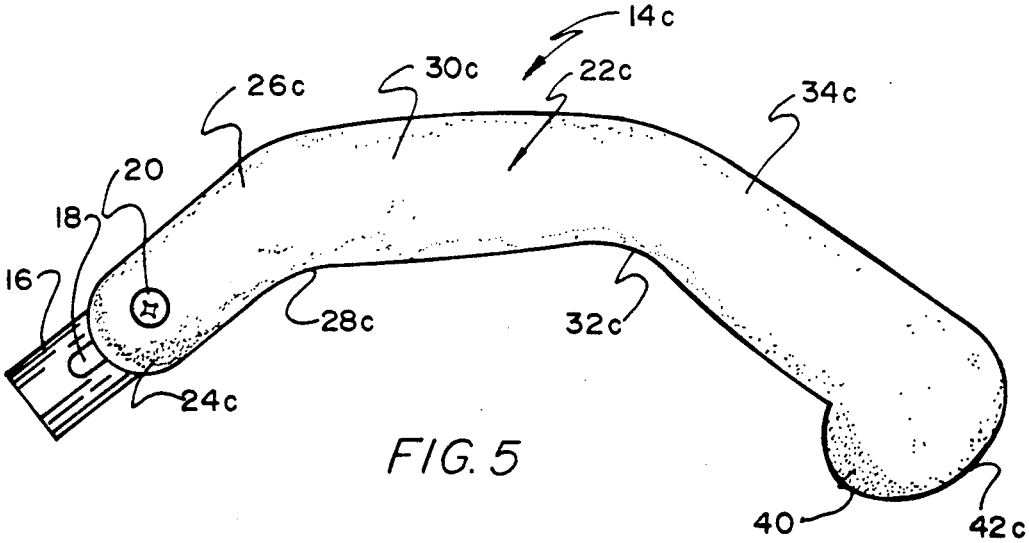
FIG. 5 is an elongated side view of the third alternative embodiment of the present invention.

FIG. 2, FIG. 3, and FIG. 5 show alternate embodiments of a utility knife 14*a*,14*b*,14*c* comprised of an elongated handle 22*a*,22*b*,22*c* having a nose 24*a*,24*b*,24*c* whereby a replaceable blade 16 is clamped by tightening a screw 20 into a recessed position. Adjacent the nose 24*a*,24*b*,24*c* is a neck 26*a*,26*b*,26*c* which is connected by a first angular bend 28*a*,28*b*,28*c* to a first extension 30*a*,30*b*,30*c*. The first extension 30*a*,30*b*,30*c* is connected by a second angular bend 32*a*,32*b*,32*c* to a second extension 34*a*,34*b*,34*c* which includes a butt end 42*a*,42*b*,42*c*. The first extension 30*a*,30*b*,30*c* and the second extension 34*a*,34*b*,34*c* are of the length and configuration to correspond to the contour of the palm of the user's hand, providing the user with a comfortable and secure grip.

Referring to FIG. 2 and FIG. 3, the first alternative embodiment (as shown in FIG. 2) includes a handle 22*a* of a different configuration to the handle 22*b* of the second alternative embodiment (as shown in FIG. 3). The second extension 34*a* of the first alternative embodiment 14*a* is disposed at an angle $\alpha$ relative to the y-axis, i.e. in the third quadrant, or opposite the disposition of the second extension 34*b* of the second alternative embodiment 14*b* at angle $\beta$ relative to axis y, i.e. in the second quadrant. The necks 26*a*, disposed at angles $\theta$ relative to the y-axis, are corresponding angles; they are both in the fourth quadrant. Hence, the handles 22*a*,22*b* have divergent second extension 34*a*,34*b* and, therefore, the handle 22*a* of the first alternative embodiment 14*a* may be more desirable over the handle 22*b* of the second alternative embodiment 14*b* depending on the leverage and the reach required for a given work space and vice versa. For instance, the handle 22*a* of the first alternative embodiment 14*a* may provide greater leverage downward in a certain situation and the handle 22*b* of the second alternative embodiment 14*b* may provide greater leverage upward in the same situation. Either handle 22*a*,22*b* could provide superior horizontal or vertical reach and leverage depending on the given set of circumstances.

Referring to FIG. 3, the handle 22*b* is hollow to provide a storage compartment 38 wherein spare blades 36 may be contained. The physical dimensions of the handle 22*b* determine the number of spare blades 36 which can be stored in the storage compartment 38. Each separate alternative embodiment 14*a*,14*b*, 14*c* may have a storage compartment 38 to store spare blades 36. This feature is not limited to the second alternative embodiment 14*b*.

Figure 4:
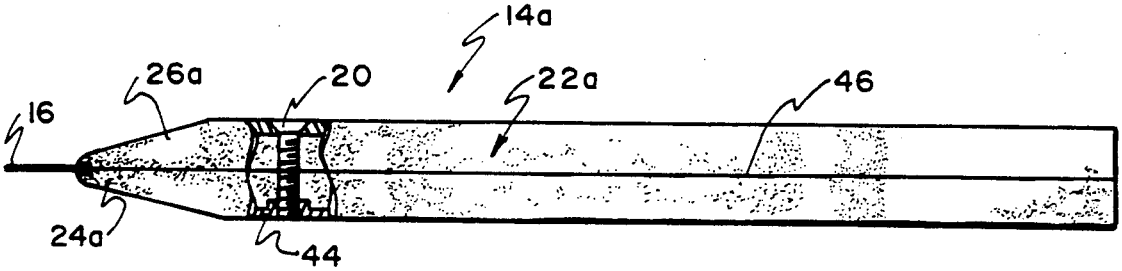
FIG. 4 is a detailed elongated view of the present invention showing the blade attaching means.

FIG. 2 and FIG. 4 show a means by which the replaceable blade 16 is clamped in the nose 24*a* of the handle 22*a* of the first alternative embodiment 14*a*. The replaceable blade 16 is held secure, in either an extended or retracted position, by inserting a screw 20 into a hole in one side of the handle 22*a* through an aperture 18 in the replaceable blade 16 and by tightening the screw 20 into the threaded boss 44 until the screw 18 is recessed and the replaceable blade 16 is tightly clamped. The replaceable blade 16 may be removed and replaced and the storage compartment 38 (as shown in FIG. 3) may be accessed by removing the screw 20. This allows the handle 22*a* to be separated along a slit 46, exposing the replaceable blades 16 and the spare blades 36. The second and third alternative embodiments 14*b*,14*c* may have similar clamping configurations to that of the first alternative embodiment 14*a*.

FIG. 5 shows a third alternative embodiment 14*c*. This alternative embodiment 14*c* includes a nodule 40 on the butt end 42*c* of the handle 22*c* opposite the nose 24*c*. This nodule 40 reduces the risk of the user's hand slipping off of the handle 14*c*, thereby providing the user greater control.

Figures 6A, 6B, 7:
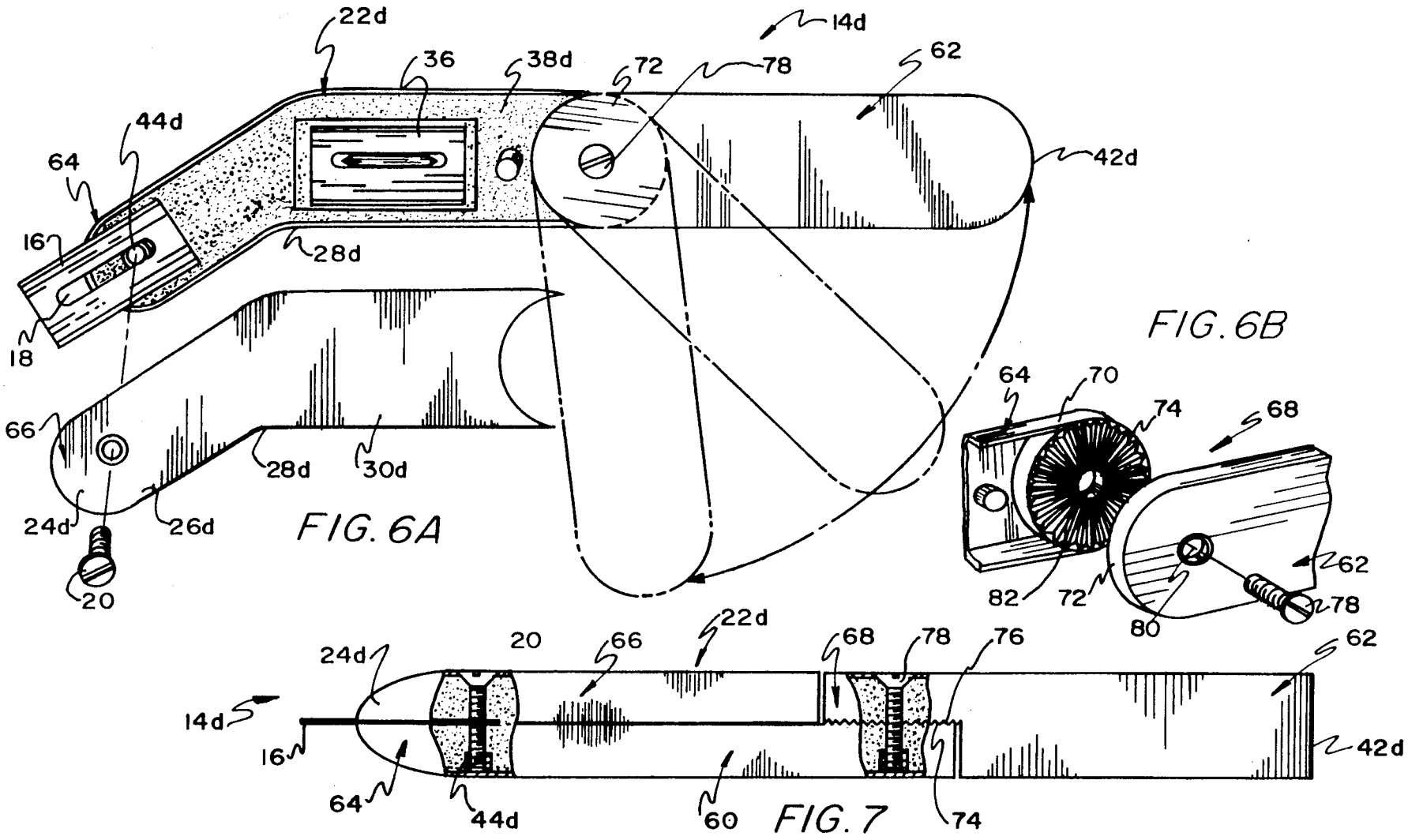
FIG. 6A is a partially exploded view of the fourth alternative embodiment of the present invention.
FIG. 6B is a detail of the adjustable pivot.
FIG. 7 is an elevational view of the fourth alternative embodiment of the present invention showing the pivotal action of the second extension.

FIGS. 6A–6B and FIG. 7 show a fourth alternative embodiment or utility knife 14*d* including a handle 22*d* having a first element 60 and a second element 62. The first element 60 is comprised of the first extension 30*d*, the first angular bend 28*d*, the neck 26*d*, and the nose 24*d*. The first element 60 is longitudinally separable into a first half 64 and a second half 66. The first element 60 is joined to the second element 62 by an adjustable pivot 68. The adjustable pivot 68 is comprised of a first half section 70 and a second half section 72. The first half section 70 is an integral part of the first half 64 of the first element 60. The second half section 72 is an integral part of the second element 62. Both the first and second half sections 70,72 of the pivot 68 include radially disposed teeth 74,76 which mesh together when secured to form a fixed angle. The pivot 68 is secured by a fastening screw 78. The fastening screw 78 is inserted in a hole 80 axially centered in the second half section 72 of the pivot 68. With the teeth 74,76 meshed together, the hole 80 aligns with a threaded hole 82 axially centered in the first half section 70 of the pivot 68. The pivot 68 is adjusted simply by loosening the fastening screw 78 enough to enable the pivot 68 to move. As an option, the first element 60 can be used independently of the second element 62.

The replaceable blade 16, which may be retractable, is clamped in the nose 24*d* and the first and second halves 64,66 are secured together by a fastening screw 20 which is inserted into the nose 24*d* of the first element 60. The fastening screw 20 is inserted through an aperture 18 in the replaceable blade 16 and is tightened securely into a threaded boss 44*d* located on the inside surface of the first half 64. A storage compartment 38*d* to facilitate the storage of spare blades 36 is located in the hollow portion of the first element 60 defined by the first half 64 and the second half 66. This storage compartment 38*d* is accessible and the replaceable blade 16 may be replaced by removing the fastening screw 20 and separating the two halves 64,66 of the first element 60.

It is to be understood that the present invention is not limited to the sole embodiment described above, but encompasses any and all embodiments within the scope of the following claims.

I claim:

1. A utility knife comprising:

an elongated body including a nose, a neck, a first extension, a second extension, a butt end, an inside edge, and an outside edge, said elongated body having a plurality of angular bends disposed along one of said edges, said elongated body further being separable into a first elongated half section and a second elongated half section, each having an inside surface, wherein said plurality of angular bends includes at least a first angular bend and a second angular bend and at least one of said first and second angular bends is an adjustable angular bend, wherein said adjustable angular bend includes a separable pivot between said first extension and said second extension, a replaceable blade, said blade including an aperture, and a fastening means to fasten said replaceable blade to said body.

2. The knife according to claim 1, wherein said separable pivot separates said body into a first element and a second element, whereby said first element functions independently of said second element.

3. The knife according to claim 2, wherein said first element is hollow and longitudinally separable into a first elongated half section and a second elongated half section, each having an inside surface, whereby said first elongated half section and said second elongated half section are secured together by inserting said fastening means into a hole in said first elongated half section of said first element, through said aperture in said replaceable blade, and tightening said fastening means into a threaded boss affixed to said inside surface of said second elongated half section of said first element opposite said hole and said replaceable blade, said fastening means comprising a screw.

4. The knife according to claim 3, wherein said knife includes a storage compartment interposed between said first elongated half section and said second elongated half section, said storage compartment being disposed within said first element, whereby said storage compartment may be accessed by removing said screw and by separating said first elongated half section and said second elongated half section.

5. A knife comprising:

an elongated body including a nose, a neck, a first extension, a second extension, a butt end, an inside edge, an outside edge, and at least two angular bends being disposed along one of said edges, at least one of said angular bends being an adjustable angular bend including a separable pivot between said first extension and said second extension separating said body into a first element and a second element, said first element being functional independently of said second element, said first element being hollow and longitudinally separable into a first elongated half section and a second elongated half section, each elongated half section having an inside surface, a replaceable blade clampable between said first elongated half section and said second elongated half section, said first elongated half section and said second elongated half section being secured together by inserting a screw into and through a hole in said first elongated half section and an aperture in a replaceable blade and by tightening said screw into a threaded boss protruding from said inside surface of said second elongated half section, a storage compartment interposed between said first elongated half section and said second elongated half section, said storage compartment being disposed within said first element, whereby said storage compartment may be accessed by removing said screw and by separating said first elongated half section and said second elongated half section.

* * * * *